US006672483B1

(12) United States Patent
Roy

(10) Patent No.: US 6,672,483 B1
(45) Date of Patent: Jan. 6, 2004

(54) DISPENSER FOR CHEMICALLY UNSTABLE PRODUCTS

(75) Inventor: Christophe Roy, Dieppe (FR)

(73) Assignee: Rexam Sofab (FR)

( * ) Notice: Subject to any disclaimer, the term of this patent is extended or adjusted under 35 U.S.C. 154(b) by 0 days.

(21) Appl. No.: 09/890,250

(22) PCT Filed: Feb. 3, 2000

(86) PCT No.: PCT/FR00/00251

§ 371 (c)(1),
(2), (4) Date: Oct. 18, 2001

(87) PCT Pub. No.: WO00/45963

PCT Pub. Date: Aug. 10, 2000

(30) Foreign Application Priority Data

Feb. 5, 1999 (FR) ..... 99 01362

(51) Int. Cl.[7] ..... B67D 5/60
(52) U.S. Cl. ..... 222/145.1; 222/136
(58) Field of Search ..... 222/137, 145.1, 222/135, 136

(56) References Cited

U.S. PATENT DOCUMENTS 3,166,221 A * 1/1965 Nielsen ..... 222/137
4,773,562 A * 9/1988 Gueret ..... 222/135
5,301,841 A * 4/1994 Fuchs ..... 222/135
5,611,463 A * 3/1997 Favre ..... 222/137
5,848,732 A * 12/1998 Brugger ..... 222/137
5,848,739 A * 12/1998 Wilkinson ..... 222/137
5,899,360 A * 5/1999 Mack et al. ..... 222/137
5,901,883 A * 5/1999 Ritsche ..... 222/137
6,341,717 B2 * 1/2002 Auer ..... 222/135

* cited by examiner

*Primary Examiner*—Gene Mancene
*Assistant Examiner*—Melvin A Cartagena
(74) *Attorney, Agent, or Firm*—Bacon & Thomas, PLLC

(57) ABSTRACT

A dispenser for chemically unstable products that result from mixing at least two liquid and/or semiliquid components, the dispenser being of the type comprising an outer housing (1) containing at least two hermetically sealed compartments (11, 12) each containing a liquid component, the compartments being provided with respective extractor members (21, 22) suitable for being actuated simultaneously and together by a single pushbutton (3) and suitable for delivering into separate delivery ducts (31, 32) formed inside said pushbutton (3) and opening to the outside via at least one ejector orifice **(31*a*, 32*a*), the dispenser being characterized in that each of said compartments (11, 12) is defined transversely by the bottom (10) of the outer housing (1) and by an internal bushing (41, 42) for supporting its extractor member (21, 22), and laterally by the wall of an internal tubular element (51, 52) whose ends are fixed in leakproof manner respectively to said bushing and to the bottom (10) of said housing (1)**.

8 Claims, 5 Drawing Sheets

DISPENSER FOR CHEMICALLY UNSTABLE PRODUCTS

BACKGROUND OF THE INVENTION

The present invention relates to a dispenser of chemically unstable products that result from mixing at least two liquid components.

Such products that are unstable over time are to be found in particular in the fields of pharmaceuticals and cosmetics where they are referred to as "extemporaneous" preparations that cannot be stored or packaged in a form suitable for application.

Thus, in traditional manner, the components are packaged separately in independent containers from which they are taken and measured out prior to being mixed together at the site of application to form the final product.

Unfortunately, that arrangement is not ergonomic and it does not provide a mode of use that is simple and practical.

Furthermore, because the members for taking the respective components are independent it is difficult to obtain balanced quantities and uniform mixing of the components.

SUMMARY OF THE INVENTION

An object to the present invention is to solve these technical problems in satisfactory manner.

According to the invention, this object is achieved by means of a dispenser characterized in that it comprises an outer housing containing at least two hermetically sealed compartments each containing a liquid component, the compartments being provided with respective extractor members suitable for being actuated simultaneously and together by a single pushbutton and suitable for delivering into separate delivery ducts formed inside said pushbutton and opening to the outside via at least one ejector orifice.

According to an advantageous characteristic, each of said compartments is defined transversely by the bottom of the outer housing and by an internal bushing for supporting its extractor member, and laterally by the wall of an internal tubular element whose ends are fixed in leakproof manner respectively to said bushing and to the bottom of said housing.

According to another characteristic, the tubular elements of each compartment are united by a partition wall.

In a another specific embodiment, the wall of the internal tubular element forms a jacket that is in contact at least in part with the wall of the outer housing.

In another embodiment, the wall of the internal tubular elements is provided with a transverse shoulder enabling it to be fixed at a distance from the wall of the outer housing.

According to yet another characteristic, the tubular elements possesses a neck suitable for receiving the internal bushing for supporting an extractor member.

Preferably, the tubular elements of each compartment are housed in a single case.

In a particular variant, said delivery ducts open to the outside via a common terminal portion.

According to another characteristic, the ejector orifice is provided in a projection projecting from the side face of the pushbutton.

The dispenser of the invention can be used with extractor members in the form of a pump and/or a valve, and without it being necessary to provide sealing gaskets.

Since the component delivery ducts, and where appropriate their respective ejection orifices, are separate, mixing cannot take place inside the dispenser, thus reducing any risk of clogging and of the product deteriorating.

Furthermore, the components are measured out in a manner that is simple, merely by adapting the respective capacities of the extractor means to the weight ratio of each component in the finished product.

The dispenser of the invention makes it possible with a single package that can be implemented in various sizes, to provide means that are simple, reliable, and effective for delivering an unstable product of two components, or more generally of multiple components.

The dispenser of the invention can be manufactured industrially in a manner that is simple, fast, and of low cost, e.g. by injection molding polypropylene.

BRIEF DESCRIPTION OF DRAWINGS

The invention will be better understood on reading the following description accompanied by drawings, in which.

DETAILED DESCRIPTION OF THE INVENTION

The dispenser shown in the figures is for packaging and dispensing liquid and/or semiliquid components suitable for mixing together to form a chemically unstable product referred to as an "extemporaneous" preparation.

Figure 1A:
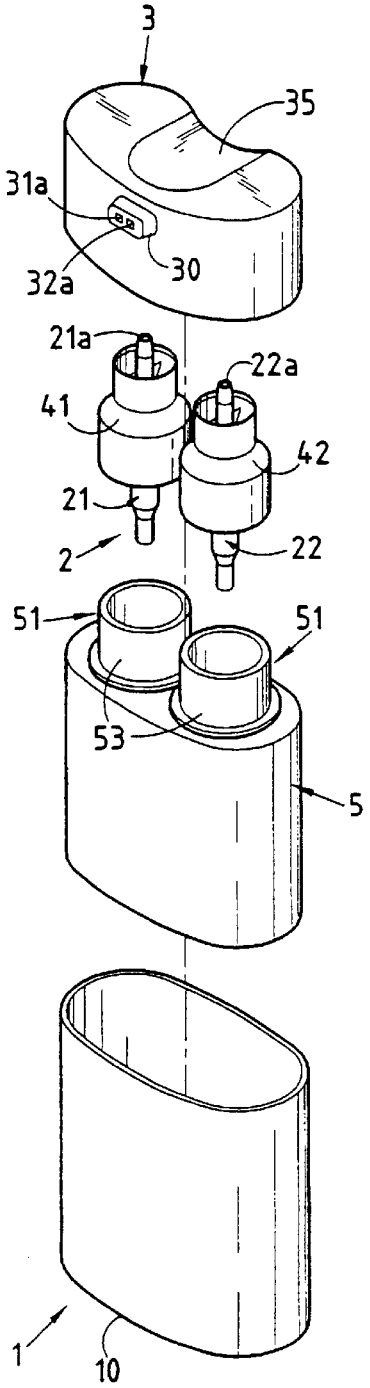
FIGS. 1A and 1B are respectively an exploded perspective view prior to assembly and a perspective view after assembly of an embodiment of a dispenser of the invention.
Figure 2B:
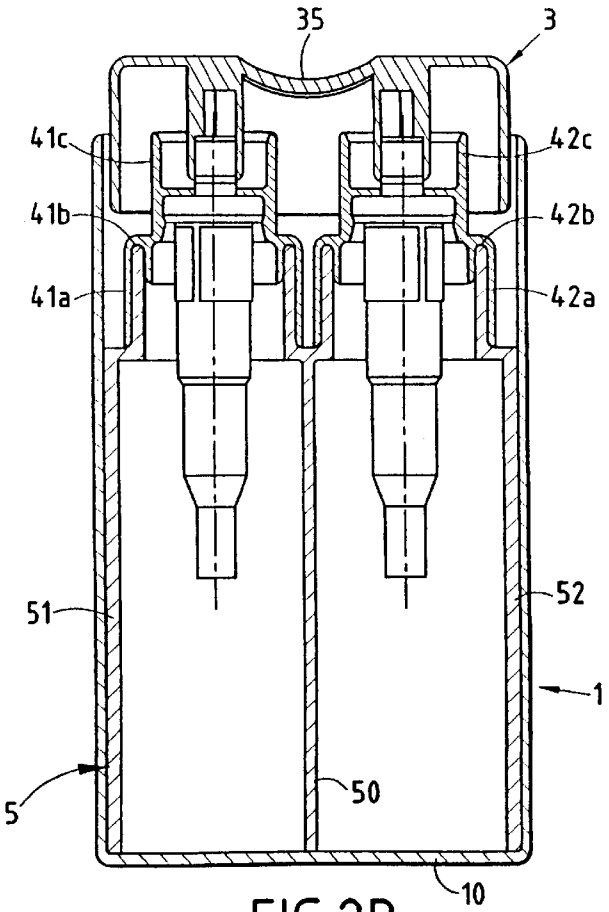
FIGS. 2A and 2B are section views of the embodiment of FIGS. 1A and 1B, respectively during a rest stage and during a dispensing stage.
Figure 2A:
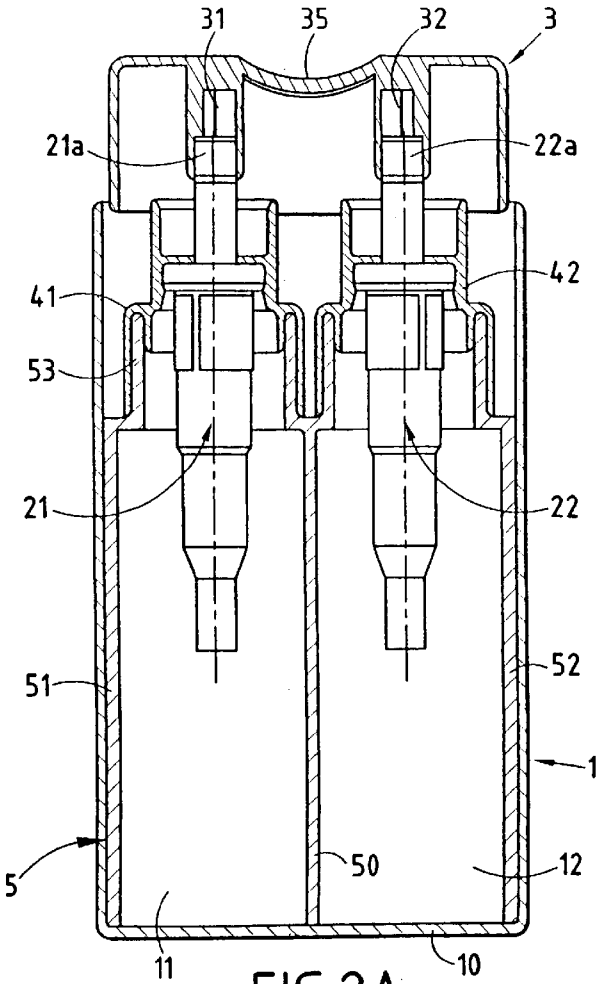

As shown in FIGS. 1A and 2A, the dispenser comprises an outer housing 1 containing at least two, and in this case exactly two, hermetically sealed compartments 11, 12, each containing a given volume of a determined liquid component.

Each compartment 11, 12 is provided with an extractor member 2 for extracting the components contained therein.

In this case, the extractor members 2 are constituted by pumps 21 and 22, but in variant embodiments in which the compartments are under pressure, for example, the members could be constituted by valves.

The extractor members 2 are suitable for being actuated simultaneously and together by a single pushbutton 3 made as a single piece and in this case fitted onto the tops of the respective delivery tubes 21*a*, 22*a* of the pumps 21, 22.

Pressing the pushbutton 3 causes the liquid components to escape from their respective compartments and to be delivered via separate ducts 31, 32 opening to the outside via at least one, and preferably via two, ejector orifices 31*a*, 32*a* formed in this case in a projection 30 projecting from the side face of the pushbutton 3.

Figure 5A:
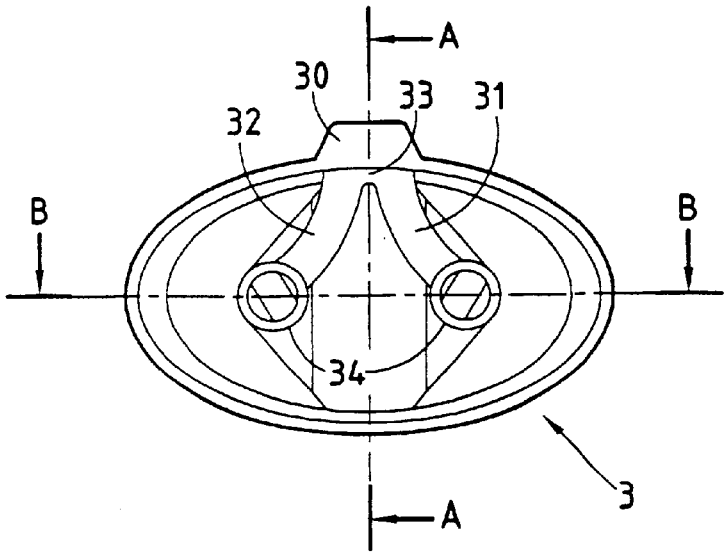
FIGS. 5A, 5B, and 5C are respectively a view from beneath, a section on AA, and a section on BB showing a pushbutton used for the dispenser of the invention.

In the embodiment shown in FIG. 5A, the delivery ducts 31, 32 open out to the outside, where appropriate, via a common terminal portion 33 participating in premixing the components.

Each of the compartments is defined transversely by the bottom 10 of the housing 1 and by an internal bushing 41, 42 supporting the extractor member, and laterally by the wall of an internal tubular element 51, 52. The ends of the tubular elements are fixed to respective bushings 41, 42 and to the bottom 10 of the housing 1.

Both tubular elements 51, 52 associated with a respective compartment 11, 12 are received in a single case 5.

The connection between the bottom 10 and the bottom edges of the tubular elements is preferably obtained by flat welding (ultrasound, . . . ) so as to ensure that both compartments 11, 12 are sealed, which compartments are separated in this case by a single partition wall 50 uniting the two tubular elements 51, 52.

When using so-called "airless" extractor members, the respective walls of the two compartments 11, 12 touch in the central portion of the dispenser.

Figure 3B:
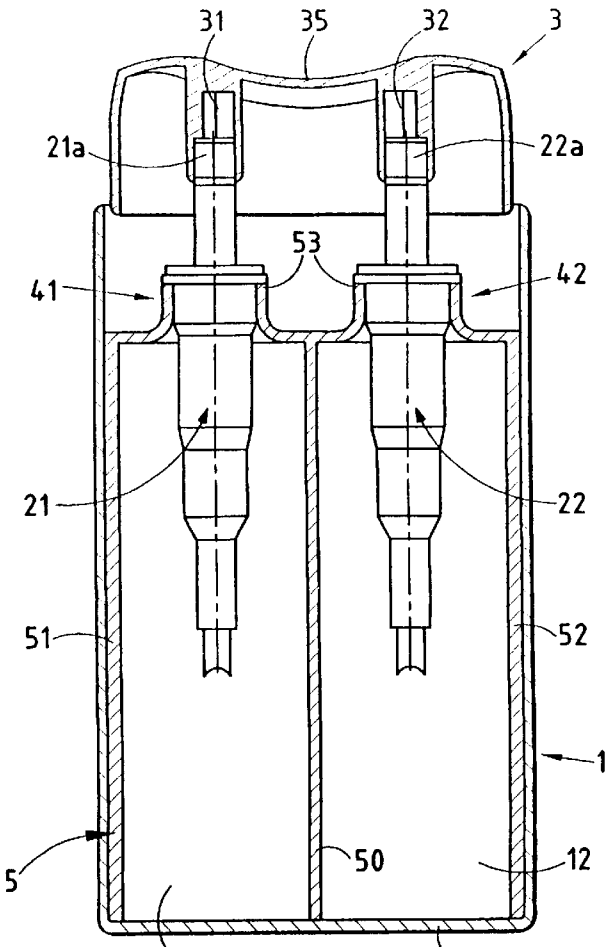
FIGS. 3A and 3B are section views of two variant embodiments of the dispenser of the invention.
Figure 3A:
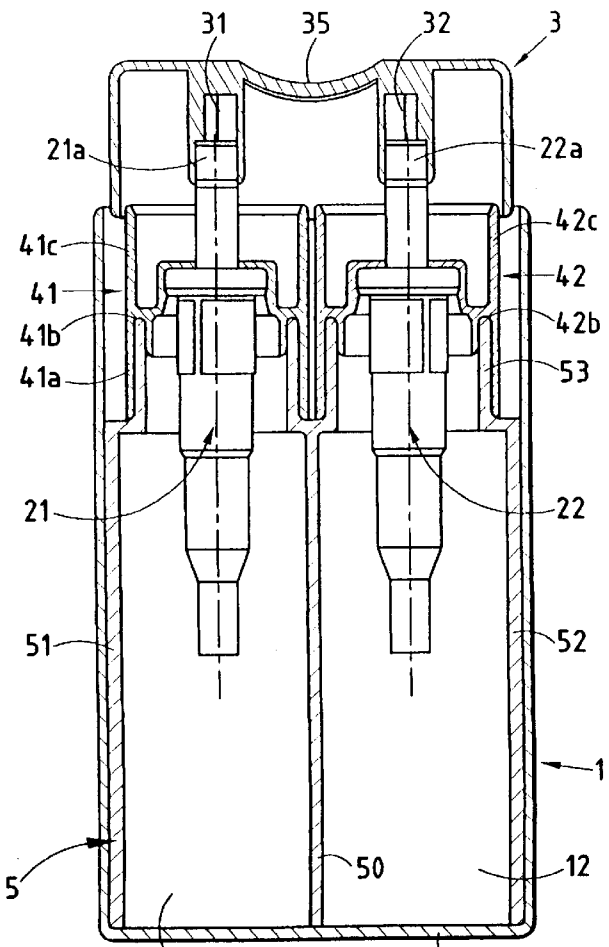

The connection between the tubular elements 51, 52 and the bushings 41, 42 are provided in the embodiments shown in FIGS. 2A and 3A by mutually engaging facing bearing surfaces that provide leakproof radial clamping.

To this end, the tubular elements are provided with respective cylindrical necks 53 for receiving the bushings.

More precisely, the bushings 41, 42 have respective peripheral skirts 41*a*, 42*a* for fitting on the outsides of the necks 53 and defining in their top portions respective peripheral inside grooves 41*b*, 42*b* that fit over the top edges of the necks 53.

Each skirt 41*a*, 42*a* is extended by a collar 41*c*, 42*c* shown respectively in FIGS. 2A, 3A as two distinct variant embodiments, serving to hold captive the top portion of a corresponding body of the pumps 21, 22.

In the variant of FIG. 3B, the bushings 41, 42 are formed in line with the tubular elements 51, 52 and are integral therewith.

The top portions of the bushings 41, 42 thus directly define the cylindrical necks 53 that serve as supports for the bodies of the pumps 21, 22.

In the embodiment of FIGS. 2A and 3, the walls of the tubular elements 51, 52 beneath the necks 53 form jackets that come into contact at least in part with the inside wall of the housing 1, and where appropriate provide a small amount of radial clamping.

The tubular elements can then be inserted to the housing 1 by axial sliding.

Figure 4A:
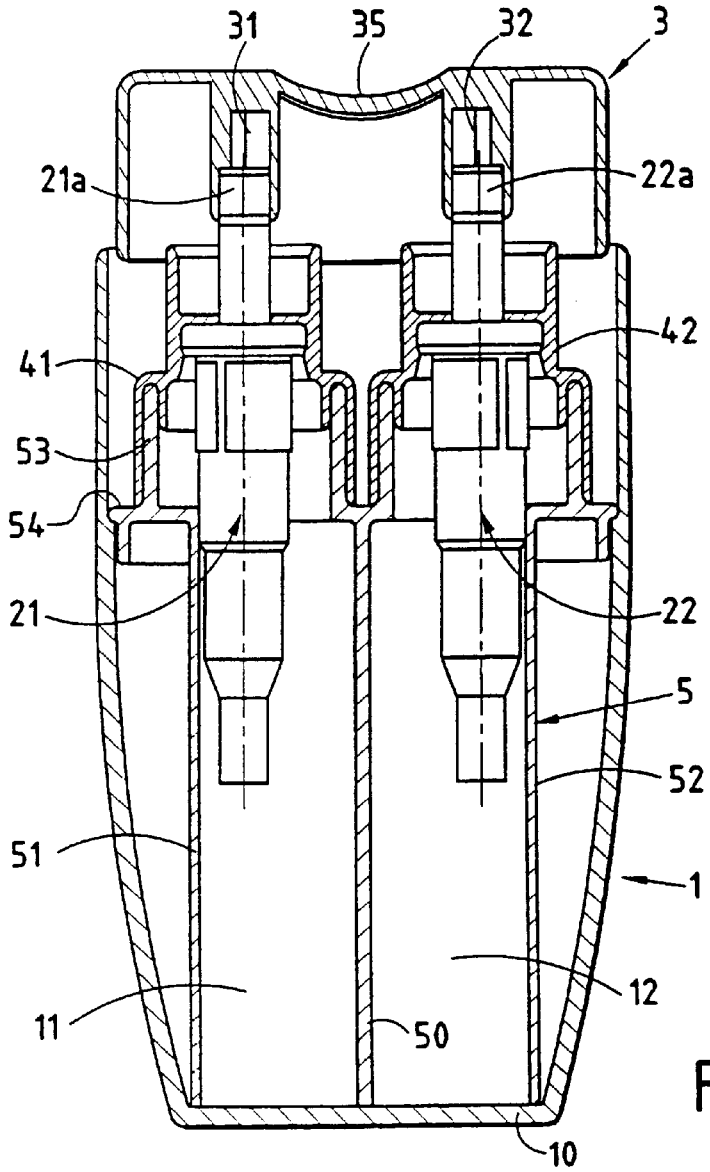
FIGS. 4A and 4B are respectively a section view and a plan view of another embodiment of a dispenser of the invention.
Figure 4B:
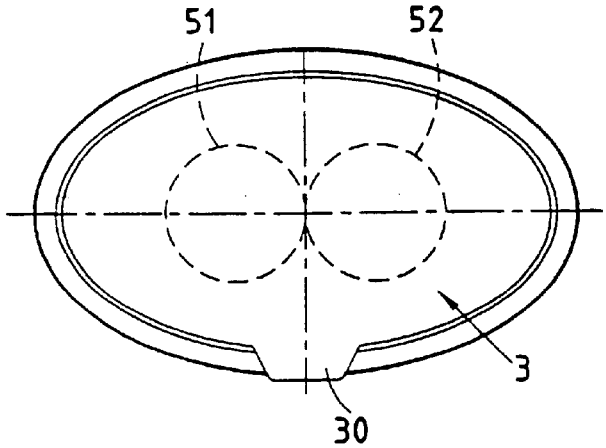

In the embodiment of FIG. 4A, the side walls of the tubular elements 51, 52 are extended at the top by transverse shoulders 54 extending radially outwards to come into contact with the inside wall of the housing 1 and form a spacer so as to enable the tubular elements to be positioned and fixed at a distance from said wall.

Figure 5B:
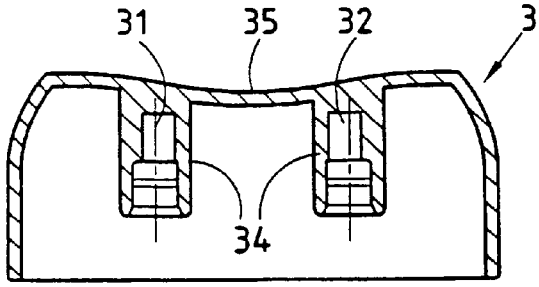
Figure 5C:
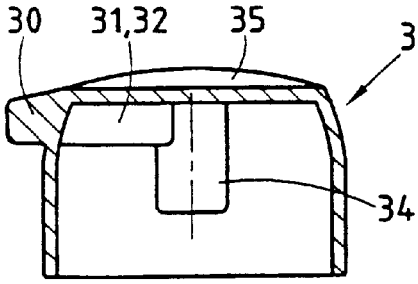

The pushbutton 3 shown in FIGS. 5A, 5B, and 5C is implemented in this case as a cap having sleeves 34 formed therein suitable for fitting on the outer ends of the delivery tubes of the pumps 21, 22 and communicating sideways with the delivery ducts 31, 32.

The top face of the pushbutton 3 is provided with an indentation 35 to make it easier to press.

Figure 1B:
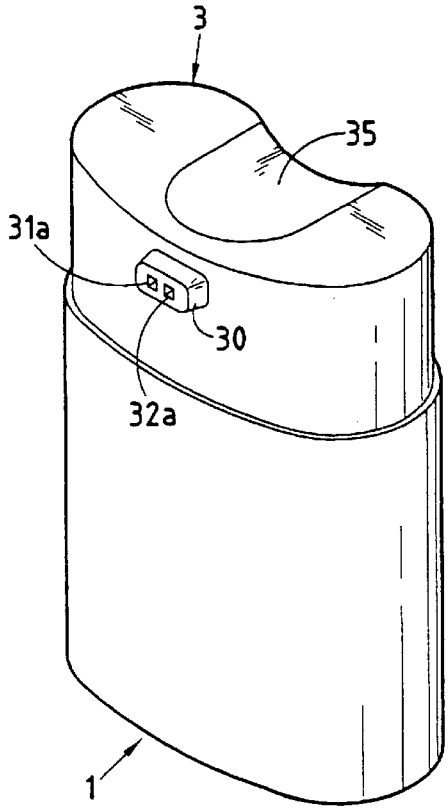

The bottom portion of the pushbutton 3 when at rest is engaged inside the top portion of the housing 1 (as shown in FIGS. 1, 2A, and 3B) inside which it moves when manual pressure is applied to actuate the pumps 21, 22 (see FIG. 2B).

What is claimed is:

1. A dispenser for chemically unstable products arranged to mix at least two liquid or semiliquid components, the dispenser comprising:

an outer housing;

at least two hermetically sealed compartments defined within the outer housing;

a pair of extractor members each disposed in a respective one of said sealed compartments;

a push button connecting to said extractor members and arranged to actuate said extractor members simultaneously, said push button including at least two delivery ducts and at least one ejector orifice, each of said ducts connected to a respective one of said extractor members and arranged to separately deliver one of said components to the atmosphere via said at least one ejector orifice; and at least two tubular elements disposed in said outer housing, each of said tubular elements having opposed open ends wherein one open end includes a bushing for supporting one of said extractor members and the other open end is sealed by a bottom wall of the outer housing, each of said compartments delimited by an inner wall of one of said tubular elements, one of said bushings and the bottom wall of the housing.

2. The dispenser according to claim 1, wherein the tubular elements of each compartment are united by a partition wall.

3. The dispenser according to claim 1 or 2, wherein at least a portion of an outer side wall of the tubular elements is in contact with an inner side wall of the outer housing.

4. The dispenser according to claim 1 or 2, wherein said tubular elements include a transverse shoulder in contact with at least a portion of an inner wall of the outer housing so as to position a tubular portion of the tubular elements a distance from the inner wall of the outer housing.

5. The dispenser according to claim 1, wherein the tubular elements include a neck configured and dimensioned to receive an internal bushing connecting to the tubular elements and the extractor members.

6. The dispenser according to claim 1, further comprising a single body case defining said tubular elements, said case configured and dimensioned to be received by said outer housing.

7. The dispenser according to claim 1, wherein the delivery ducts connect near said ejector orifice.

8. The dispenser according to claim 1, wherein the ejector orifice includes a projection extending from a side face of the push button.

* * * * *